US006851583B2

(12) United States Patent
Masuzzo et al.

(10) Patent No.: US 6,851,583 B2
(45) Date of Patent: Feb. 8, 2005

(54) DOUBLE-ACTING PUMP FOR EJECTING A PRODUCT FROM A CONTAINER

(75) Inventors: Ettore Masuzzo, Eppstein (DE); Stefan Christ, Hochheim (DE)

(73) Assignee: AERO Pump GmbH, Hochheim/Main (DE)

( * ) Notice: Subject to any disclaimer, the term of this patent is extended or adjusted under 35 U.S.C. 154(b) by 0 days.

(21) Appl. No.: 10/618,193

(22) Filed: Jul. 11, 2003

(65) Prior Publication Data

US 2004/0050858 A1 Mar. 18, 2004

(30) Foreign Application Priority Data

Jul. 13, 2002 (DE) ..... 102 31 749

(51) Int. Cl.[7] ..... B65D 88/54

(52) U.S. Cl. ..... 222/321.6; 222/321.7; 222/321.9; 222/420

(58) Field of Search ..... 222/321.1, 321.2, 222/321.4, 321.5, 321.6, 312.7, 321.8, 321.9, 383.1, 385, 380, 341, 376, 382, 372, 189.06, 189.09, 189.11, 422, 420; 239/333

(56) References Cited

U.S. PATENT DOCUMENTS 2,556,180 A * 6/1951 Hamilton et al. ..... 222/321.4
4,830,284 A * 5/1989 Maerte ..... 239/333
5,373,972 A 12/1994 Bystrom et al.
5,614,172 A 3/1997 Geimer
5,655,689 A 8/1997 Fuchs et al.
5,692,649 A * 12/1997 Schwab ..... 222/321.3
6,053,368 A * 4/2000 Geimer ..... 222/189.09
6,189,739 B1 * 2/2001 von Schuckmann ..... 222/182
6,308,867 B1 * 10/2001 Wolter ..... 222/321.6
6,412,659 B1 * 7/2002 Kneer ..... 222/82
6,443,370 B1 * 9/2002 Brulle et al. ..... 239/333

FOREIGN PATENT DOCUMENTS

| | | |
|---|---|---|
| CA | 2303880 | 8/1997 |
| DE | 2709796 | 9/1978 |
| DE | 197 42 59 C2 | 8/1999 |
| WO | 0183010 | 11/2001 |

* cited by examiner

*Primary Examiner*—Frederick C. Nicolas
(74) *Attorney, Agent, or Firm*—Friedrich Kueffner

(57) ABSTRACT

A double-acting pump for ejecting a product from a container includes a piston which is axially slideable in a housing and is sealed by the housing. A hollow piston rod extends the axial bore of the piston and is slideable in a closing cap and has an actuating head, wherein, when the actuating head is actuated, the piston builds up a pressure in a pressure chamber against a restoring force of a spring. An outlet duct extends through the actuating head to an outlet opening. When subjected to the restoring force of the spring, the piston releases a passage between the pressure chamber and openings of a second housing portion. A medium which kills germs and bacteria is arranged in an expansion chamber. The dispensing stroke volume of the piston corresponds to the volume of a drop of the liquid.

8 Claims, 3 Drawing Sheets

DOUBLE-ACTING PUMP FOR EJECTING A PRODUCT FROM A CONTAINER

BACKGROUND OF THE INVENTION

1. Field of the Invention

The present invention relates to a double-acting or lift and force pump for ejecting a product from a container, with a housing in which a piston with an axial bore is axially slidable and sealed by a first housing portion, with a hollow piston rod which extends the axial bore of the piston and is slidable in an opening of a closing cap of the housing and container, wherein the hollow piston rod has at its free end a tightly fastened actuating head, wherein, when the actuating head is actuated, the piston builds up a pressure against the force of a restoring spring in a pressure chamber of the housing, wherein an outlet duct connected to the bore extends through the actuating head and through a check valve up to an ejection opening for the product, and with at least one opening in a second housing portion between the first housing portion and the closing cap.

2. Description of the Related Art

A double-acting pump of this type disclosed in DE 27 09 796 B2 is suitable for ejecting or spraying a product out of a container, but is not suitable for ejecting or dispensing individual drops of a liquid, particularly not in an upside down position, as it is frequently required for dispensing liquid medicaments which are to be introduced drop by drop, for example, into the eyes, ears or nose.

SUMMARY OF THE INVENTION

It is the primary object of the present invention to provide a double-acting pump of the above-described type which is suitable for dispensing individual drops of a liquid and which simultaneously prevents a contamination of the liquid by germs and bacteria which penetrate from the outside through the outlet opening.

In accordance with the present invention, the piston in the non-actuated state thereof under the restoring spring force leaves a passage between the pressure chamber and the at least one opening in the second housing portion, wherein a section of the outlet duct adjacent the check valve has between two cup-shaped sleeves of the actuating head, which are laterally tightly placed against each other, a groove formed on the outer side of the inner sleeve, wherein the groove is covered by the outer sleeve and extends up to an expansion chamber formed in front of the outlet opening formed in the bottom of the outer sleeve, and wherein a germ-killing and bacteria-killing medium is arranged in the expansion chamber, wherein the medium permits flow of the liquid to the outlet opening, wherein the dispensing stroke volume of the piston corresponds to the volume of the drop of the liquid, and wherein the width of the outlet opening prevents a spraying effect.

While the opening in the second housing portion makes it possible that the container is substantially emptied in the upside down position of the container, the passage permits suctioning of the liquid during a suction stroke of the piston in the upside down position. The groove at the outer side of the inner sleeve of the actuating head facilitates the formation of the section of the outlet duct adjacent the check valve prior to the insertion of the two sleeves into each other and the sealing of the groove against contamination. The pressure and the velocity of the liquid during a discharge stroke of the piston is reduced in the expansion chamber adjacent the groove, so that the liquid, as a result of the reduction of the pressure and velocity together with the width of the outlet opening which prevents a spraying action, is dispensed only in the form of a drop without being sprayed.

It is possible to form the passage by an axial extension of the at least one opening provided in the second housing portion. However, it is preferably ensured that the passage is formed by at least one axial groove in the inner side of a middle housing portion between the first and second housing portions. This weakens the wall of the housing to a smaller extent than would be the case in an extension of the at least opening.

The germ-killing and bacteria-killing medium may include an alloy of silver and copper. Such an alloy has been found to be vary effective against germs and bacteria.

The germ-killing and bacteria-killing medium may also be constructed as a helix which surrounds the inner end of the inner sleeve and leaves sufficient space for the unimpaired flow of the liquid to be dispensed. This configuration of the medium provides in a simple manner a large surface area of the medium for the contact with the liquid for killing any germs and bacteria contained in the liquid.

In accordance with another feature, an annular air filter which is impermeable to germs contained in the air is tightly inserted so as to rest against the piston rod in a recess surrounding the piston rod adjacent the opening of the closing cap. As a result, it is possible that a negative pressure produced in the container during the ejection of liquid is compensated by air subsequently flowing through the filter and the opening in the closing cap which guides the piston rod, while a contamination of the liquid by the germs contained in the air is prevented.

The filter preferably also contains a silver/copper alloy and additionally activated carbon, so that not only germs, but also bacteria are effectively killed.

In accordance with another feature, the actuating head includes a pipe piece extending coaxially with the piston rod and the closing cap has a pipe piece extending coaxially to the piston rod, wherein the pipe pieces engage in each other essentially tightly and are movable relative to each other in the axial direction, wherein the movement is limited by undercuts. These pipe pieces not only facilitate the shifting of the piston in the housing when the actuating head is actuated and guidance of the actuating head by the pipe piece of the closing cap, but also a substantially tight seal of the hollow space in the pipe pieces, while still a compensation of the air pressure in the hollow space is possible during the relative displacement of the two pipe pieces when the actuating head is actuated and released.

Also, an opening rim of the housing can be engaged in an annular groove of the closing cap by a snap seat. This facilitates the assembly of the closing cap and the housing, and the manufacture thereof of plastic material by an injection molding process.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
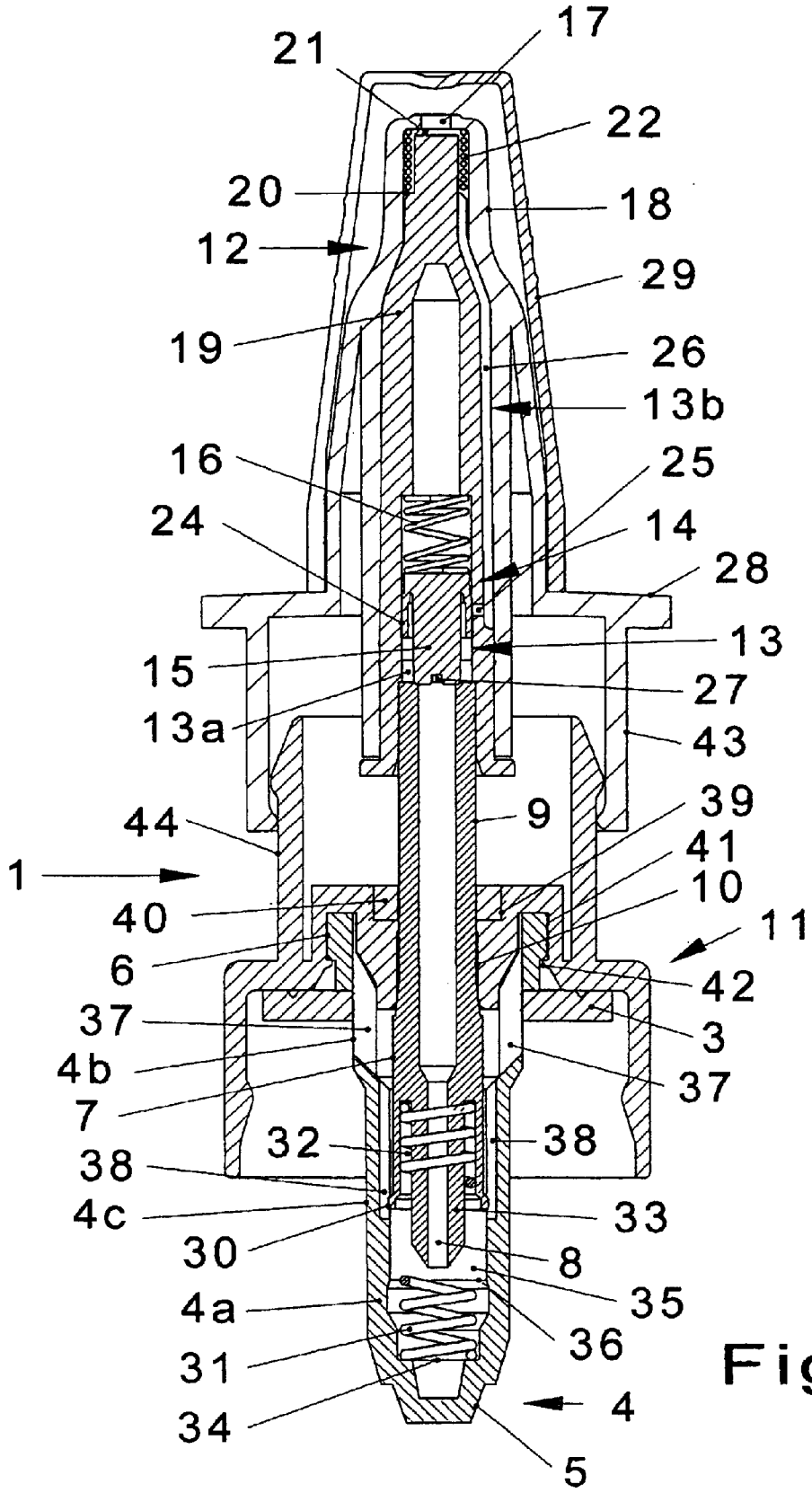
FIG. 1 is an axial sectional view of a double-acting pump according to the present invention, shown in the non-actuated state prior to the placement on a container for a liquid medicament to be dispensed by individual drops.

The double-acting pump 1 shown in the drawing is tightly attached by a snap seat on the slightly radially protruding rim 6 of the opening of a container 2 through a sealing ring disk 3 arranged between the pump 1 and the container 2. The double-acting pump 1 includes a cup-shaped housing 4 with a closed bottom 5. A hollow cylindrical piston 7 is axially displaceable in the housing 4. The piston 7 is sealed relative to the inner side of the housing 4 in a first housing portion 4*a*. The bore 8 of the piston 7 continues in a hollow piston rod 9 which is integrally connected to the piston 7. The piston rod 9 is slidable in an opening 10 of a closing cap 11 of the housing 4 and container 2 so as to be substantially sealed with the exception of a slight play.

An actuating head 12 of the double-acting pump 1 is tightly and securely placed on the free end of the piston rod 9 which protrudes out of the housing 4. An outlet duct 13 which continues the bore 8 extends through the actuating head 12. The outlet duct 13 continues through a check valve 14 with a valve closing piece 15 and a restoring spring 16 up to an ejection opening 17 in a cup-shaped outer sleeve 18 of the actuating head 12. Placed in the outer sleeve 18 is a second sleeve 19 which tightly rests against the inner side of the outer sleeve 18. The inner diameter of an end portion of the sleeve 18 adjacent the bottom of the outer sleeve 18 is reduced relative to the remaining portion of the sleeve 18. In the same manner, the outer diameter of the inner sleeve 19 is reduced at an end portion of the sleeve 19 which projects into the reduced diameter portion of the sleeve 18, wherein the end portion of the sleeve 19 includes another step-like transition 20 to a reduced diameter portion and extends into the vicinity of the opening 19. As a result, an expansion chamber 21 is defined between the sleeves 18 and 19 in the end portion areas thereof. A germ-killing and bacteria-killing medium 22 is arranged in this expansion chamber 21. This medium forms a helix which surrounds the inner end of the inner sleeve 18 which has the smallest diameter and leaves sufficient space for the essentially unimpaired flow of a liquid 23, i.e., a medicament, to be dispensed from the container 2 by individual drops. The medium 22 contains an alloy of silver and copper which is effective for killing germs and bacteria. The width of the outlet opening 17 is dimensioned with such a size that the liquid 23 can only be dispensed by individual drops and cannot be sprayed.

The valve closing piece 15 is of a rubber elastic material, i.e., an elastomer, and has a cylindrical body which is surrounded approximately in the axial middle thereof by a sealing lip 24. The sealing lip 24 rests with a resilient force produced by its own elasticity against the inner side of a first section of the outlet duct 13 extending coaxially to the piston rod 9 and, in the non-actuated state of the actuating head 12, blocks a transverses bore 25 in the adjacent section 13*b* of the outlet duct 13. This section further includes a groove 26 in the outer side of the inner sleeve 19. The groove 26 is covered by the outer sleeve 18 and extends up to the expansion chamber 21, i.e., up to the diameter transition 20. The expansion chamber 21, which is located adjacent the transition 20 and has a significantly increased diameter relative to the width of the groove 26, supports the injection of the liquid 23 by individual drops.

A transversely extending groove 27 for the penetration of the liquid to be dispensed is formed in the end face of the closing piece 15 which is located adjacent the free end of the piston rod.

The outer sleeve 18 has a circumferentially extending shoulder 28 for pressing down the actuating head 12 by means of two fingers of a hand and is covered by a protective cap 29 which is mounted by a snap seat. This protective cap 29 is removed before the double-acting pump 1 is actuated.

Figure 2:
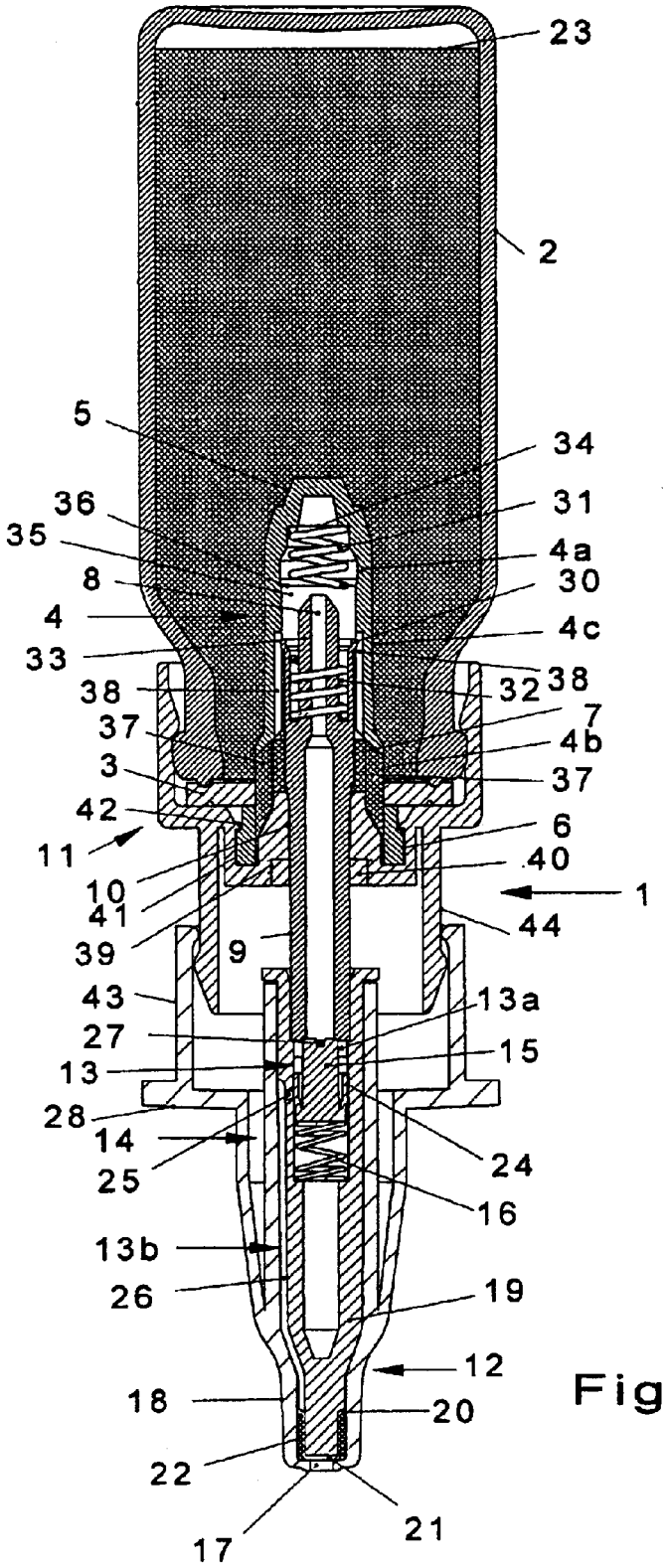
FIG. 2 is an axial sectional view of the double-acting pump according to the present invention, shown placed on a container in the upside down position, prior to an actuation for dispensing liquid.

In the non-actuated position according to FIGS. 1 and 2, the piston 7 rests with a circumferential sealing lip 30 at its free end tightly against the inner side of the housing 4. Above the sealing lip 30, the piston permits a play between itself and the inner side of the housing 4. A restoring spring 31, shown in broken lines, rests in the piston 7 against the bottom of an annular chamber 32 which is defined by the outer wall of the piston 7 and the pipe piece 33, on the one hand, and against a shoulder 34 in the housing 4, on the other hand. The housing 4 has at the lower end of a pressure chamber 35 defined by the housing 4 as seen in FIG. 1 a step 36, wherein the inner diameter of the housing 4 is below the step 36 slightly greater than the outer diameter of the sealing lip 30 of the piston 7.

Above the upper end position of the piston 7 as shown in FIG. 1, slot-shaped openings 37 are formed in the second section 4*b* of the housing 4 which is located adjacent the closing cap 11, wherein the openings 37 connect the interior of the housing 4 with the interior of the container 2 above the maximum filling level of the liquid 23 contained in the container 2 in the upright position as shown in FIG. 1. A single opening 37 would essentially be sufficient. In the non-actuated state according to FIGS. 1 and 2, the piston 7 releases under the force of the restoring spring 31 a passage 38 in the form of axial grooves in the inner side of a middle housing portion 4*c* between the first housing portion 4*a* and the second housing portion 4*b*. Also in this case, it would be sufficient to provide a single groove 38 in the middle housing portion 4*c*.

An annular air filter 40 which rests against the piston rod 9 is tightly placed in a recess 39 which surrounds the piston rod 9 and is located adjacent the opening 10 of the closing cap 11. The air filter 40 is impermeable to germs contained in the air and contains a silver/copper alloy as well as activated carbon, so that air penetrating through the filter 40 and the opening 10 as a result of the negative pressure occurring in the container 2 when the liquid 23 is ejected, is freed of germs and bacteria.

The opening rim 6 of the housing 4 is snapped by a snap seat in an annular groove 41 of the closing cap 11 behind a flat rib 42.

The actuating head 12 has a pipe piece 43 extending coaxially to the piston rod 9 and the closing cap 11 has a pipe piece 44 extending coaxially to the piston rod 9. The pipe pieces 43 and 44 engage almost tightly into each other and are moveable relative to each other in the axial direction, wherein the relative movement is limited by undercuts.

After the container 2 has been filled with the liquid 23, i.e., a medicament for eyes, ears or nose, which is to be dispensed by individual drops, the closing cap 11 including the parts of the double-acting pump 1 connected to the closing cap 11 are placed on the opening rim 6 of the housing 4 by a snap seat, wherein the connection is sealed by a sealing ring disk 3.

Figure 3:
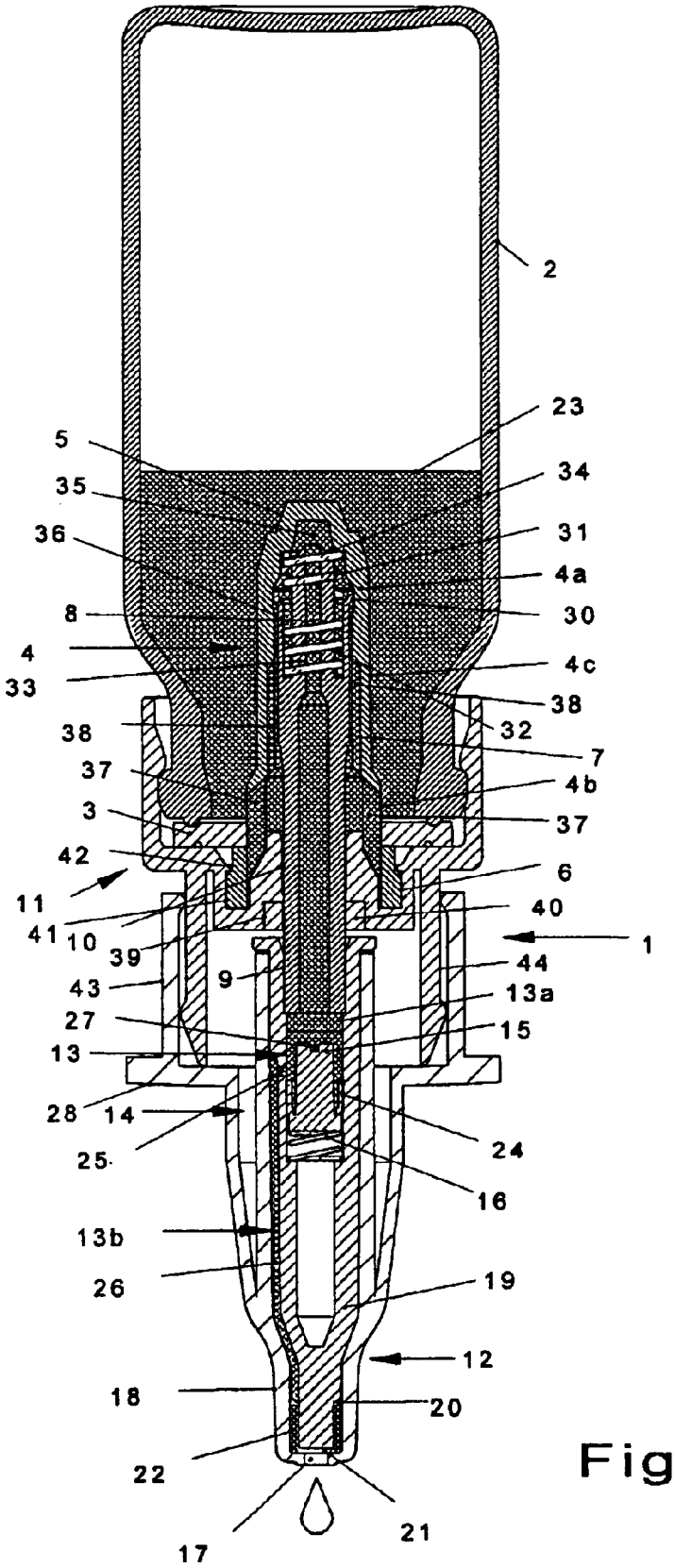
FIG. 3 is the same axial sectional view as FIG. 2, shown at the end of an actuation for dispensing liquid.

When the actuating head 12 is actuated for the first time in the upside down position of the double-acting pump 1 and the container 2 shown in FIG. 2 by a manual application of a pressure on the annular shoulder 28, the piston 7 moves against the force of the restoring spring 31 in the pressure chamber 5 in the direction toward the step 36. The air pressure produced as a result in the pressure chamber 35, in the bore 8 and in the first section 13*a* of the outlet duct 13 presses the sealing lip 24 of the valve closing piece 15 tightly against the inner side of the first section 13*a* of the outlet duct 13 and the valve closing piece 15 is pressed against the force of the restoring spring 16 further into the sleeve 19, so that the transverse bore 25 is released. The compressed air which is initially still contained in the pressure chamber 35 can then escape through the bore 8 and the outlet duct 13. After the manual pressure is removed, the restoring spring 31 presses the piston 7 and the restoring spring 16 presses the valve closing piece 15 again into the initial position shown in FIGS. 1 and 2. The resulting negative pressure in the pressure chamber 35 causes the liquid 23 to be suctioned through the slots 37 and the passage 38 into the pressure chamber 35, in the upside down position of the arrangement as seen in FIG. 2. After several such pressure and suction strokes of the piston 7, the double-acting pump 1 is filled with the liquid 23 up to the outlet openings 17, as illustrated in FIG. 3. After another pressure stroke of the piston 7, a drop of the liquid 23 emerges from the outlet opening 17 without being sprayed, because, on the one hand, the width or diameter of the outlet opening 17 is very large, approximately 1.1–1.3 mm, preferably about 1.2 mm, and, on the other hand, the expansion chamber 21 also has such a size that the liquid 23 is not accelerated during the ejection relative to the flow velocity produced in the outlet duct section 13*b*. The volume of the stroke of the piston 7 corresponds to the volume of the drop to be dispensed and is dimensioned in accordance with the required drop quantity as measured in milligrams. Consequently, another drop is dispensed during each further suction and pressure stroke. The pressure exerted in the pressure chamber 35 during a pressure stroke stops at the moment at which the sealing lip is moved past the step 36.

Any germs and bacteria which penetrate from the outside through the outlet opening 17 are killed in the helically shaped medium 22. Also, any germs and bacteria contained in the liquid 23 are killed at the large surface of the medium 22, so that the germs and bacteria come not into contact with the eyes, ears or nasal openings to be treated by the medicament.

When the container 2 is emptied, a negative pressure is produced in the container 2. This negative pressure is compensated by air which is suctioned through the filter 40, the play between the opening 10 and the piston rod 9 and the openings 37 into the container 2. As a result, any germs and bacteria are killed by the silver/copper alloy and activated carbon contained in the filter 40. For this purpose, the filter 40 is manufactured of a porous plastics material, preferably polyethylene, in which the alloy and the activated carbon are contained.

In accordance with a modified embodiment of the present invention, the grooves 38 are omitted and instead the openings 37 extend to the lower end of the grooves 38 as seen in FIG. 1. In the position of the piston 7 shown in FIGS. 1 and 2, the passage would be directly provided through the openings 37. However, the configuration of the passage in the form of grooves 38 provides the advantage that the wall of the housing 4 is less weakened, so that it can better withstand the pressure which occurs when the housing 4 is pressed into the annular groove 41 of the closing cap 11.

While specific embodiments of the invention have been shown and described in detail to illustrate the inventive principles, it will be understood that the invention may be embodied otherwise without departing from such principles.

We claim:

1. A double-acting pump for ejecting a product from a container, the pump comprising, a housing, a piston with an axial bore axially slideable in the housing, wherein the piston is sealed by a first housing portion, a hollow piston rod which extends the axial bore of the piston, wherein the hollow piston rod is displaceable in an opening of a closing cap for the housing and container, wherein the hollow piston rod has at a free end thereof a tightly attached actuating head, wherein, when the actuating head is actuated, the piston builds up a pressure against a force of a restoring spring in a pressure chamber of the housing, wherein the actuating head contains an outlet duct connected to the bore and extending through a check valve to an ejection opening for the product, wherein at least one opening is provided in a second housing portion between the first housing portion and the closing cap, wherein, in a non-actuated state of the pump, the piston releases under the force of the restoring spring a passage between the pressure chamber and the at least one opening in the second housing portion, wherein a section of the outlet duct adjacent the check valve has between an inner and an outer cup-shaped sleeve of the actuating head, which sleeves are laterally tightly placed against each other, a groove formed on an outer side of the inner sleeve, wherein the groove is covered by the outer sleeve and extends up to an expansion chamber formed in front of an outlet opening formed in a bottom of the outer sleeve, wherein a germ-killing and bacteria-killing medium is arranged in the expansion chamber, wherein the medium permits flow of the liquid to the outlet opening, wherein a dispensing stroke volume of the piston is equal to a volume of the drop of the liquid, and wherein a width of the outlet opening is selected to prevent a spraying effect.

2. The double-acting pump according to claim 1, wherein the passage is formed by at least one axial groove in an inner side of a middle housing portion arranged between the first and second housing portions.

3. The double-acting pump according to claim 1, wherein the germ-killing and bacteria-killing medium comprises an alloy of silver and copper.

4. The double-acting pump according to claim 1, wherein the germ-killing and bacteria-killing medium is comprised of a helix which surrounds an inner end of the inner sleeve and leaves sufficient space for an unimpaired flow of the liquid to be dispensed.

5. The double-acting pump according to claim 1, wherein an annular air filter is tightly inserted so as to rest against the piston rod in a recess surrounding the piston rod adjacent an opening of the closing cap, wherein the air filter is impermeable to germs.

6. The double-acting pump according to claim 5, wherein the filter comprises a silver/copper alloy and activated carbon.

7. The double-acting pump according to claim 1, wherein the actuating head comprises a pipe piece extending coaxially with the piston rod and the closing cap comprises a pipe piece extending coaxially to the piston rod, wherein the pipe pieces engage almost tightly in each other and are movable relative to each other in an axial direction, wherein the movement is limited by undercuts.

8. The double-acting pump according to claim 1, wherein an opening rim of the housing is snapped into an annular groove of the closing cap with a snap seat.

* * * * *